US010872588B2

(12) United States Patent
Cashman

(10) Patent No.: US 10,872,588 B2
(45) Date of Patent: Dec. 22, 2020

(54) PERCUSSION INSTRUMENT, CAJON AND EXTERNAL SNARE

(71) Applicant: Carson J. Cashman, Pittsburgh, PA (US)

(72) Inventor: Carson J. Cashman, Pittsburgh, PA (US)

(73) Assignee: LUSON DRUMS, LLC, Pittsburgh, PA (US)

( * ) Notice: Subject to any disclaimer, the term of this patent is extended or adjusted under 35 U.S.C. 154(b) by 171 days.

(21) Appl. No.: 15/942,542

(22) Filed: Apr. 1, 2018

(65) Prior Publication Data

US 2019/0304415 A1 Oct. 3, 2019

(51) Int. Cl.
*G10D 13/02* (2020.01)
*G10D 13/18* (2020.01)
*G10D 13/10* (2020.01)

(52) U.S. Cl.
CPC ..... *G10D 13/02* (2013.01); *G10D 13/10* (2020.02); *G10D 13/18* (2020.02)

(58) Field of Classification Search
CPC ..... G10D 13/02; G10D 13/10; G10D 13/18
USPC ..... 84/415
See application file for complete search history.

(56) References Cited

U.S. PATENT DOCUMENTS 1,722,032 A * 7/1929 Bower ..... G10D 13/02 84/415
3,206,244 A * 9/1965 Kurvink ..... B60J 3/0208 296/97.6
4,882,872 A * 11/1989 Todd ..... A01K 97/04 43/55
9,406,286 B1 * 8/2016 Simonek ..... G10D 13/025
9,666,170 B2 5/2017 Simonek
2012/0011983 A1 * 1/2012 Koumarianos ..... G10D 3/00 84/291
2018/0204549 A1 * 7/2018 Metz ..... G10D 13/021

FOREIGN PATENT DOCUMENTS

DE 202005000987 8/2005
WO 2013026502 2/2013

OTHER PUBLICATIONS

Mauro Mussoni, Cajon Rock External Snare, https://www.youtube.com/watch?v=uRB03O7yMp4, Oct. 5, 2014. (Year: 2014).*
Mauro Mussoni, Cajon Rock Snare Out on off, https://www.youtube.com/watch?v=pXSn7LrpTBU, Mar. 18, 2014. (Year: 2014).*
Louson Drums, External snare mechanism for cajon, https://www.youtube.com/watch?v=KcfQBTpkyQ0, Apr. 13, 2017 (Year: 2017).*
TiMOZ Tablet Cajon, Mar. 4, 2014.
GECKO C-68Z Portable Traveling Cajon Box Drum Hand Drum Zebra Wood, Jun. 17, 2014.
Tycoon Percussion TK-PCPP Portable Practice Pad Cajon, May 7, 2015.
CAJON2GO, Jan. 21, 2016.

* cited by examiner

*Primary Examiner* — Jianchun Qin
(74) *Attorney, Agent, or Firm* — Michael P. Alexander

(57) ABSTRACT

A percussion instrument, includes a Cajon body including a front striking surface, a floating snare assembly positioned at a portion of the front striking surface, and at least one connector connecting the Cajon body and the floating snare assembly. The floating snare assembly includes at least one snare wire contacting the front striking surface.

18 Claims, 9 Drawing Sheets

PERCUSSION INSTRUMENT, CAJON AND EXTERNAL SNARE

FIELD

The present application relates to the field of cajon percussion instruments.

BACKGROUND

A cajon is a percussion instrument typically played while sitting on the cajon and by slapping a front striking surface of the cajon with hands, fingers, or sometimes with various implements such as brushes, mallets, or sticks. Sheets of solid wood have typically been used for a frame of the cajon, and a thin sheet of plywood has typically been used as the front striking surface or "tapa". A sound hole is typically cut on a back surface of the frame. Originally these instruments were only large wooden boxes, but recent versions have included stretched cords, guitar strings, rattles, drum snares, or bells in an interior of the Cajon to provide for a variety of added sound effects.

SUMMARY

In one embodiment, a percussion instrument, includes: a Cajon body including a front striking surface; a floating snare assembly positioned at a portion of the front striking surface, the floating snare assembly including at least one snare wire contacting the front striking surface; at least one connector connecting the cajon body and the floating snare assembly.

In an aspect, cajon body may further include a rear surface, an upper surface, a lower surface, a left-side surface, and a right-side surface.

In an aspect, the at least connector may include: a first elastic connector removably connecting between a lower portion of the left-side surface of the cajon body and a first end portion of the floating snare assembly; and a second elastic connector removably connecting between a lower portion of the right-side surface of the cajon body and a second end portion of the floating snare assembly.

In an aspect, asound hole may be defined in the left-side surface or right-side surface of the cajon body.

In an aspect, a sound hole cover may be coupled to the left-side surface or right-side surface of the cajon body.

In an aspect, the first strap connector may be provided on an upper portion of the left-side surface and a second strap connector may be provided on an upper portion of the left-side surface.

In another embodiment, a cajon, includes: a cajon body having a front striking surface, a rear surface, and at least one additional surface between the front striking surface and the rear surface, wherein a sound hole is defined in the additional surface; and an adjustable sound hole cover coupled to the additional surface and configured to cover and uncover at least a portion of the sound hole.

In an aspect, the adjustable sound hole cover may be coupled to the additional surface by way of a fastener, and wherein the adjustable sound hole cover may be rotatable about the fastener to cover and uncover the portion of the sound hole.

In an aspect, the cajon body may include the front striking surface, the rear surface, an upper surface, a lower surface, a left-side surface, and a right-side surface, and wherein the sound hole may be defined in the upper surface, the lower surface, the left-side surface, or the right-side surface.

In an aspect, the sound hole may be defined in the left-side surface or the right-side surface.

In an aspect, a first strap connector may be provided on an upper portion of the left-side surface and a second strap connector may be provided on an upper portion of the left-side surface.

In an aspect, the cajon body may have a maximum dimension in a range of 9 inches to 27 inches.

In yet another embodiment, a snare assembly for floating engagement with a front striking surface of a cajon body, includes: a strip of material having a first surface and a second surface opposite the first surface, the strip of material having a first connector at a first end portion thereof and having a second connector at a second end portion thereof; and a snare wire coupled to the second surface.

In an aspect, the first and second connectors may be first and second holes extending through the strip of material.

In an aspect, the plurality of snare wires may be coupled to the second surface.

In an aspect, ends of each snare wire amy be coupled to the second surface and central portions of each snare wire may extend outwardly from the second surface.

In an aspect, a length of the strip of material may be in a range of 6 to 18 inches.

Other embodiments of the disclosed cajon and external snare will become apparent from the following detailed description, the accompanying drawings and the appended claims.

DETAILED DESCRIPTION

The following describes the illustrated embodiment of the present application along with variations and features thereof. It is understood that additional various features and modifications are considered as part of the invention as defined in the appended claims.

Figure 1:
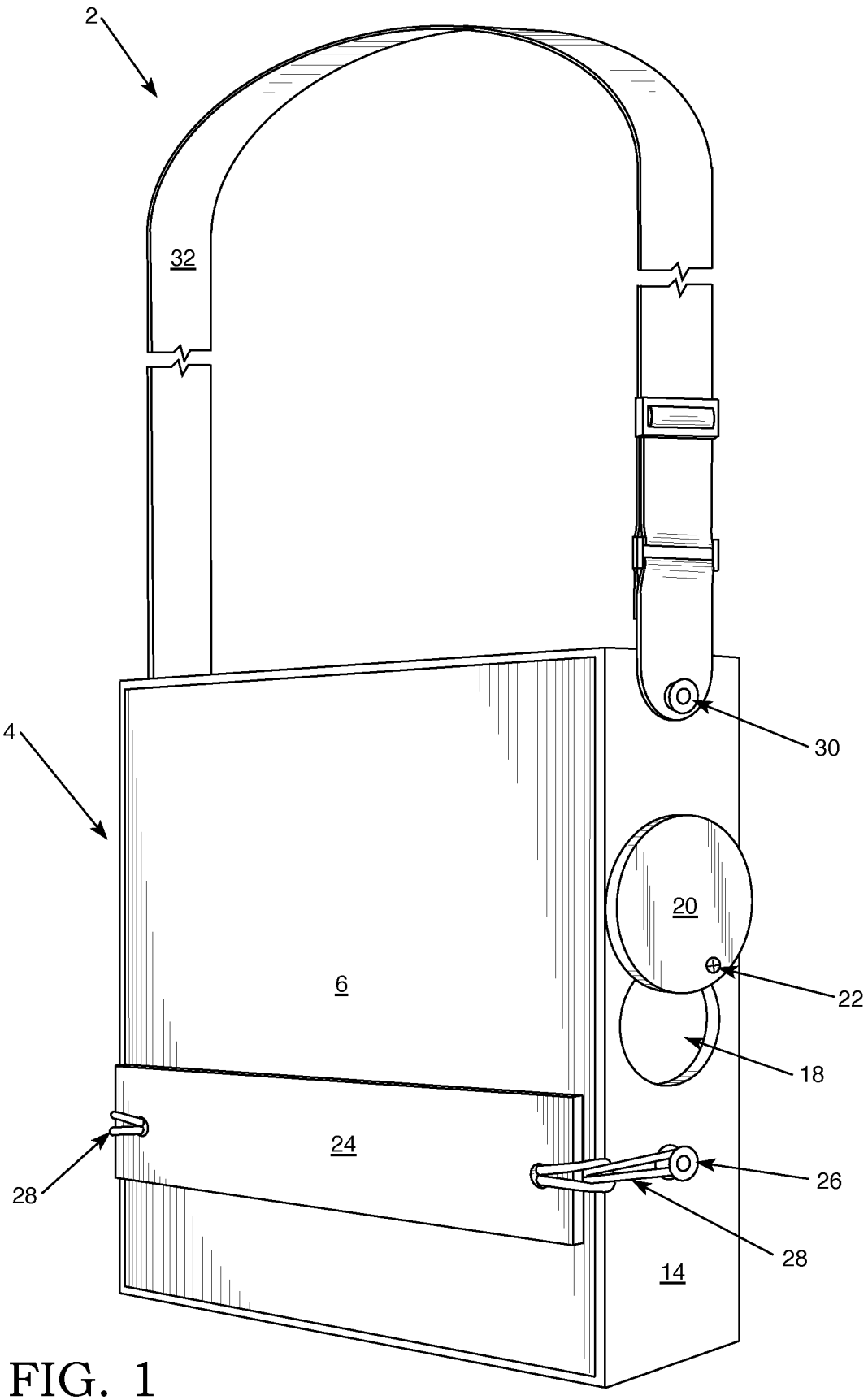
FIG. 1 is a perspective view of the cajon with removable external snare.
Figure 2:
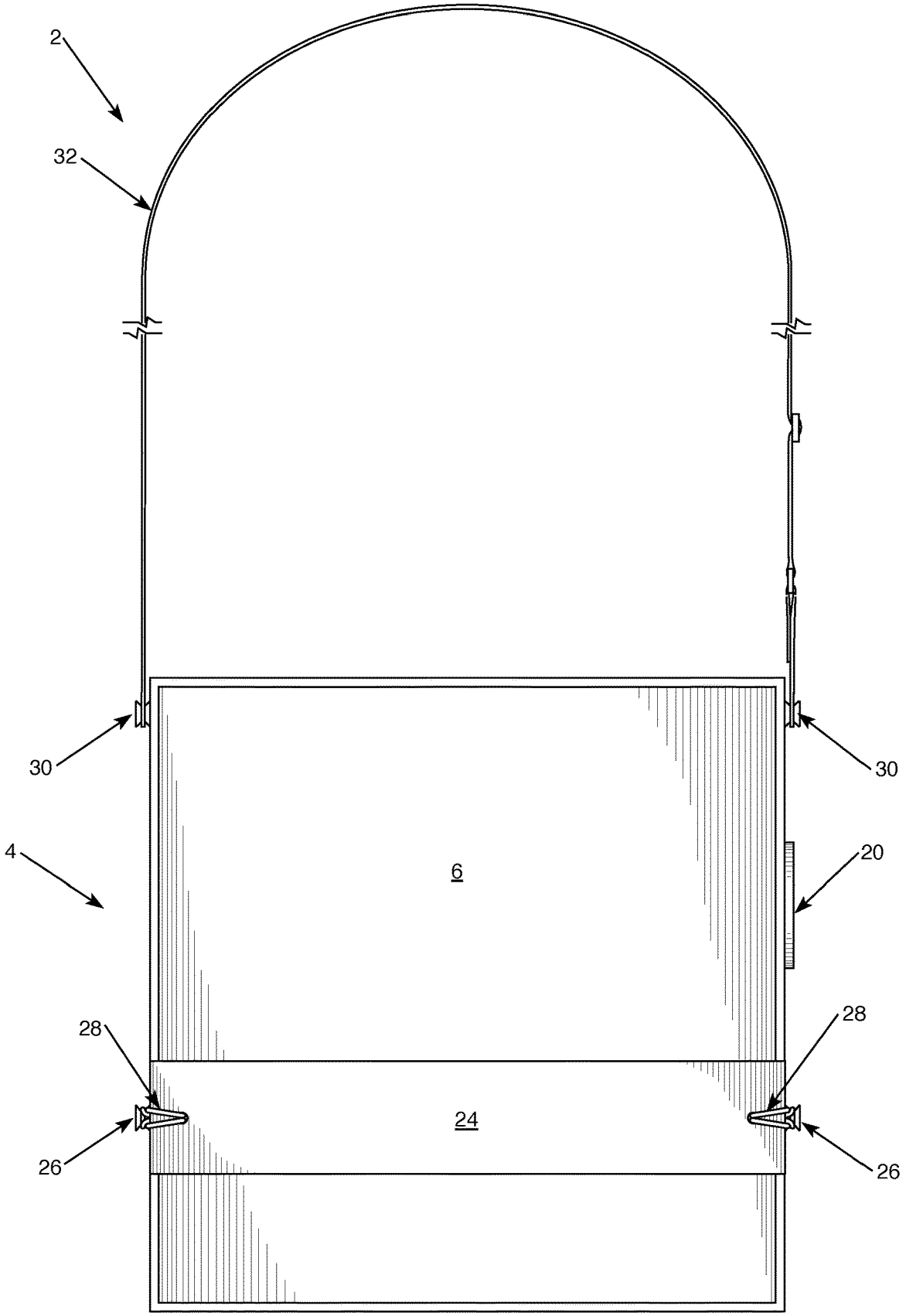
FIG. 2 is a front view of the cajon with removable external snare of FIG. 1.
Figure 3:
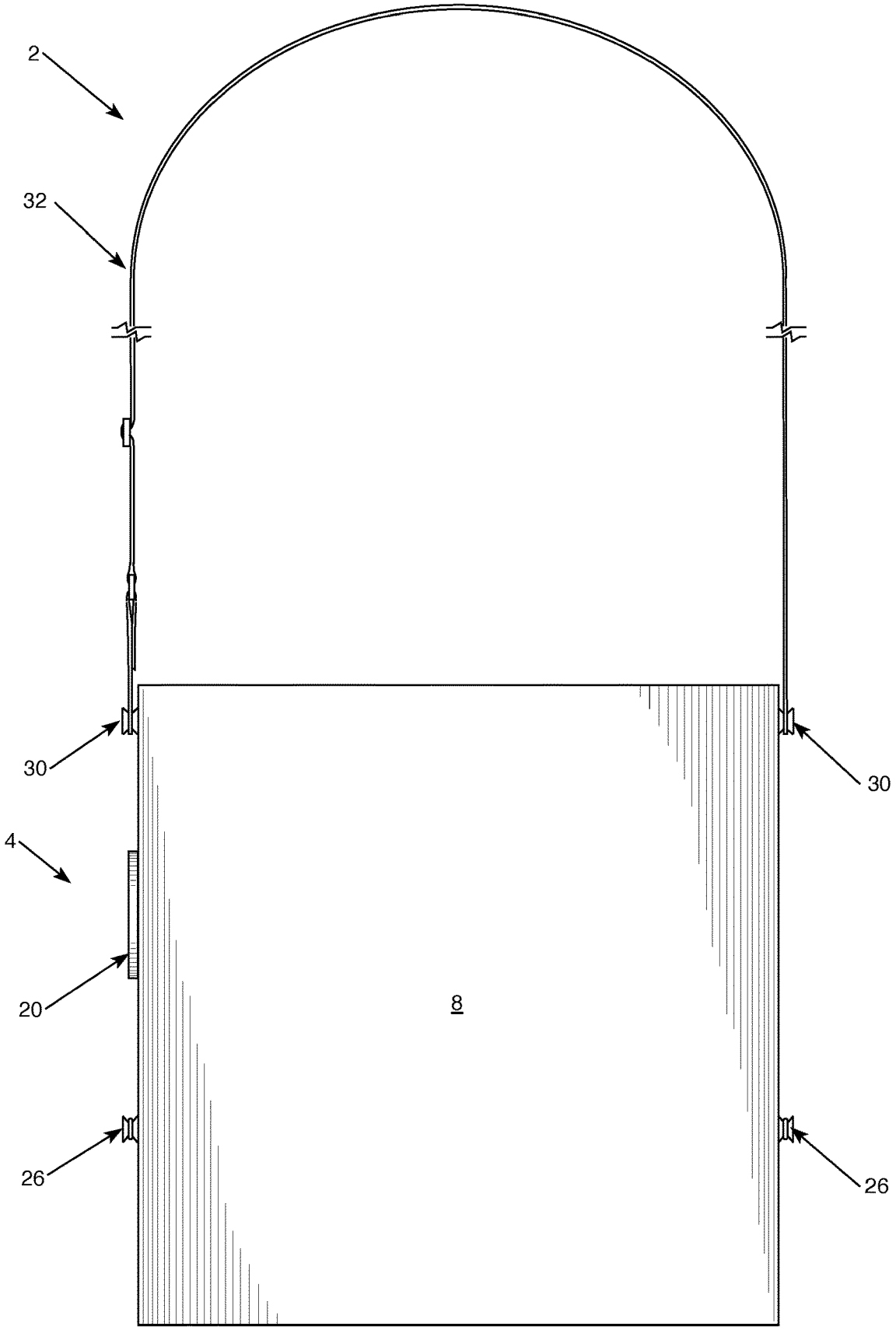
FIG. 3 is a rear view of the cajon with removable external snare of FIG. 1.
Figure 4:
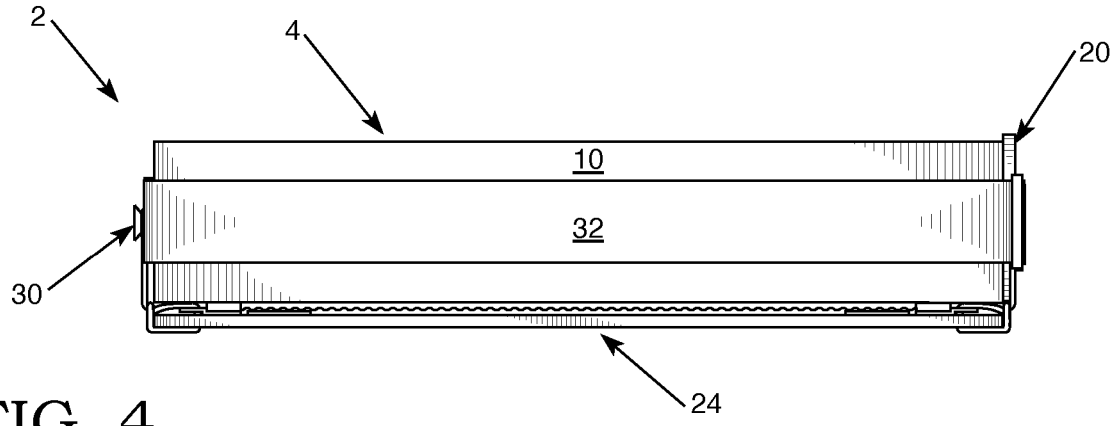
FIG. 4 is a top view of the cajon with removable external snare of FIG. 1.
Figure 5:
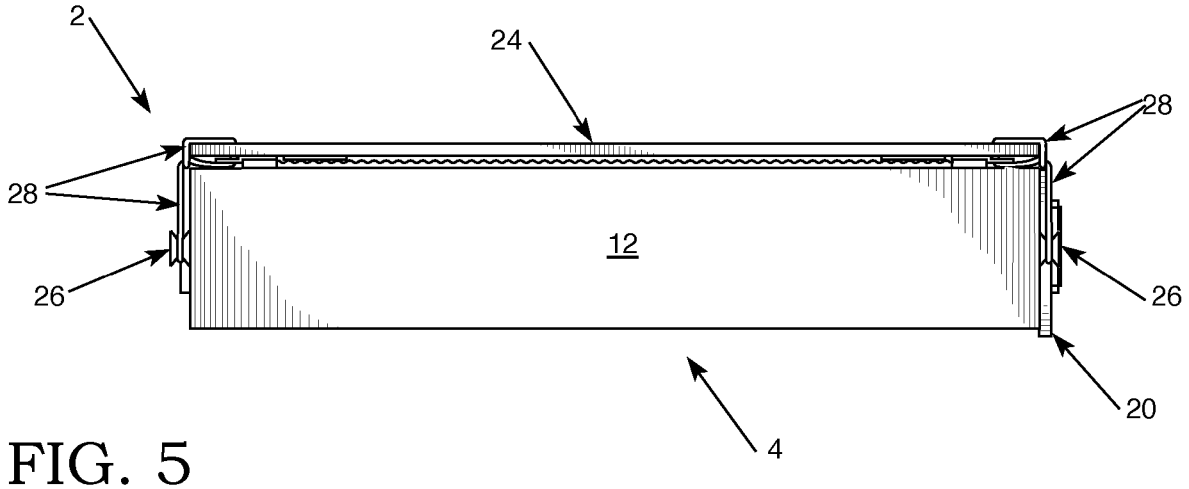
FIG. 5 is a bottom view of the cajon with removable external snare of FIG. 1.
Figure 6:
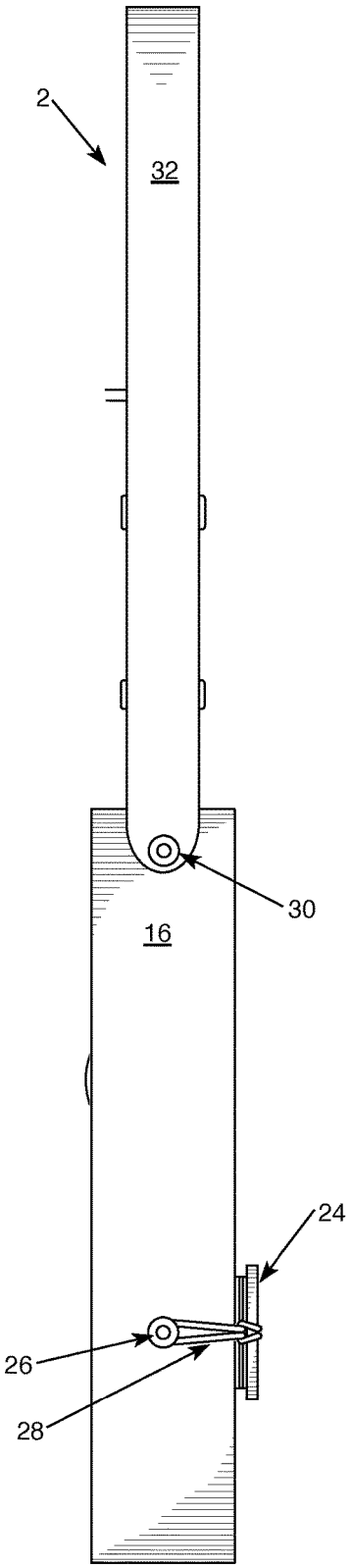
FIG. 6 is a left-side view of the cajon with removable external snare of FIG. 1.
Figure 7:
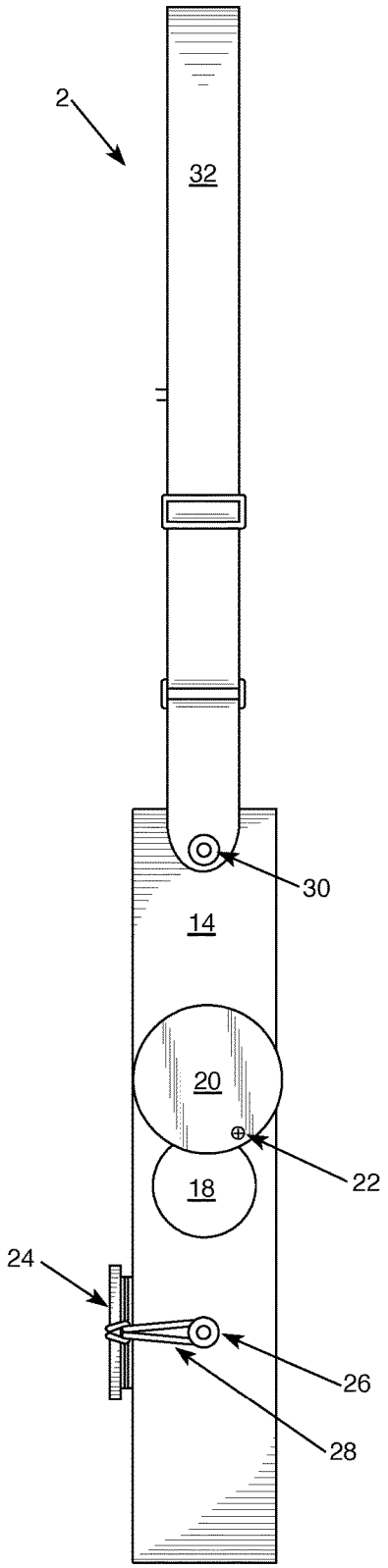
FIG. 7 is a right-side view of the cajon with removable external snare of FIG. 1, with an open sound hole.
Figure 8:
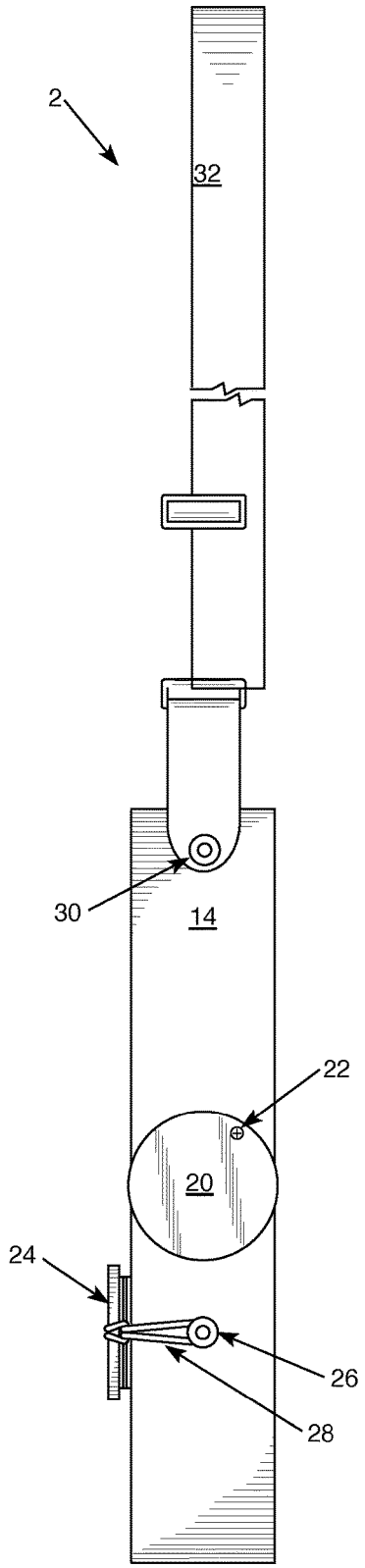
FIG. 8 is a right-side view of the cajon with removable external snare of FIG. 1, with a closed sound hole.
Figure 9:
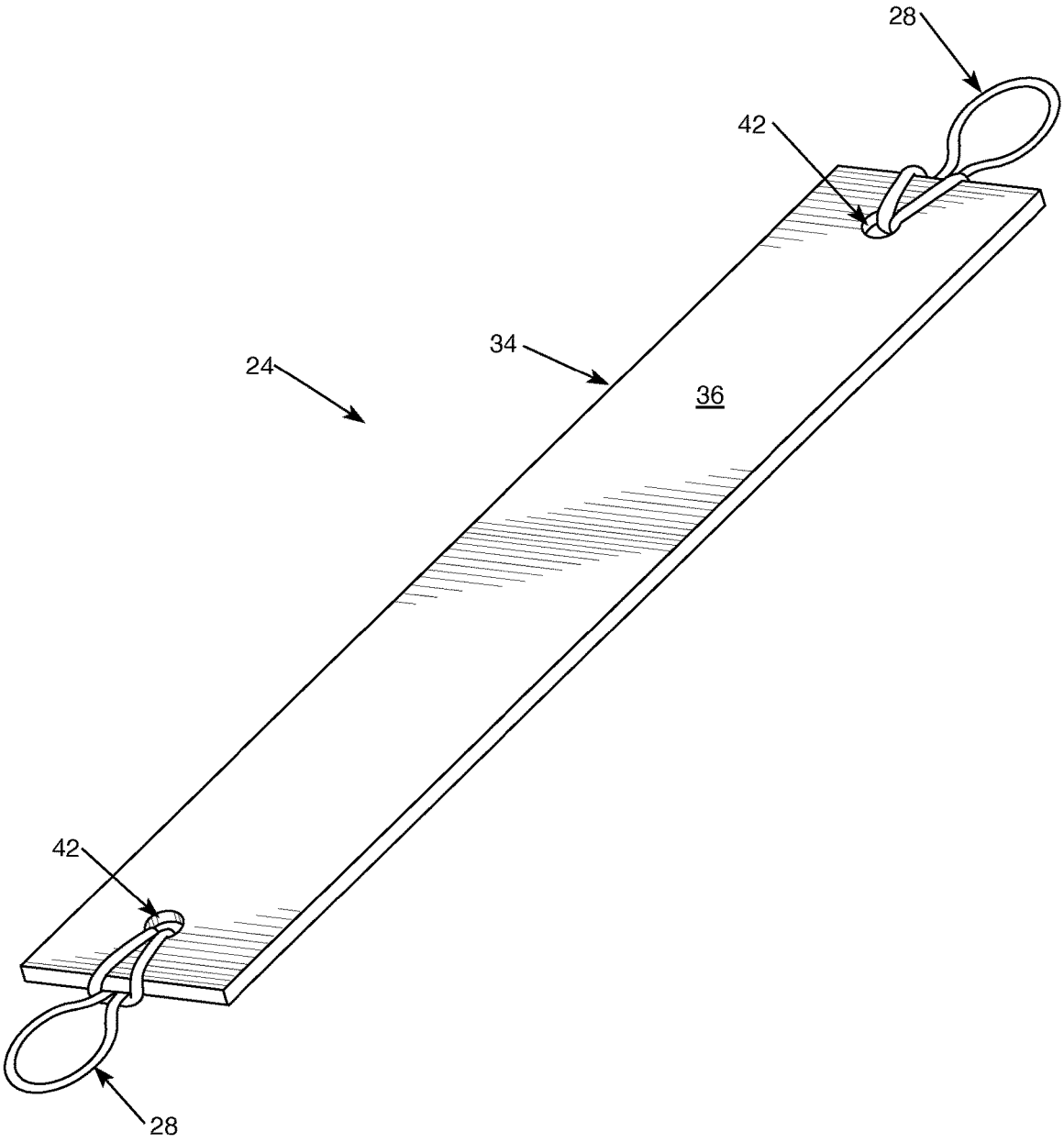
FIG. 9 is a perspective view of the removable external snare of FIG. 1 with a configuration of elastic bands shown in broken lines.
Figure 10:
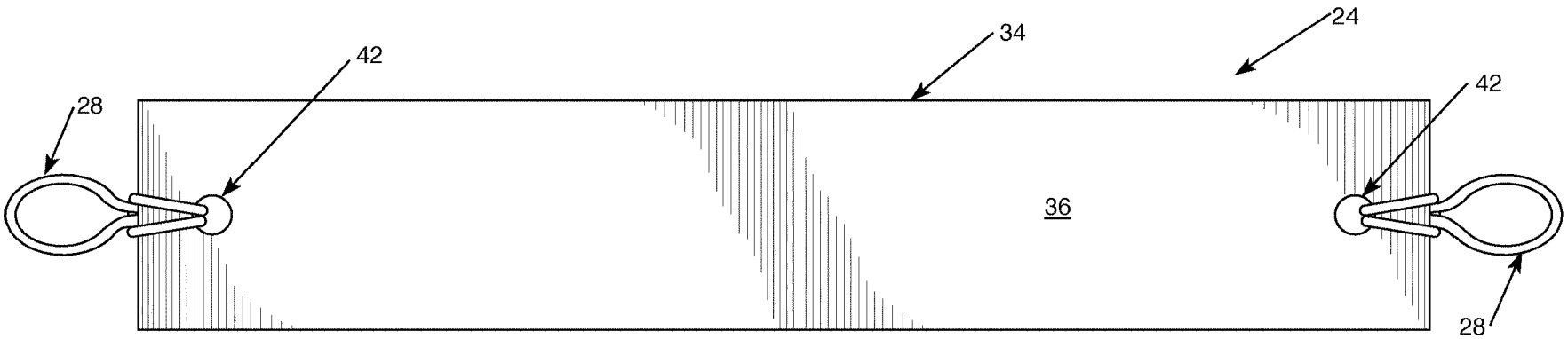
FIG. 10 is a front view of the removable external snare of FIG. 9.
Figure 11:
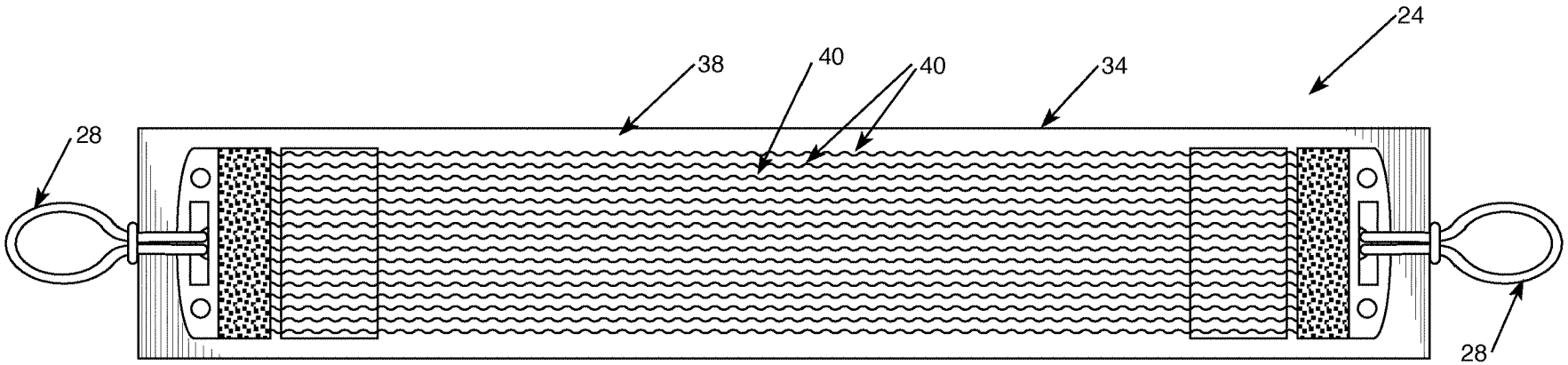
FIG. 11 is a rear view of the removable external snare of FIG. 9.
Figure 12:
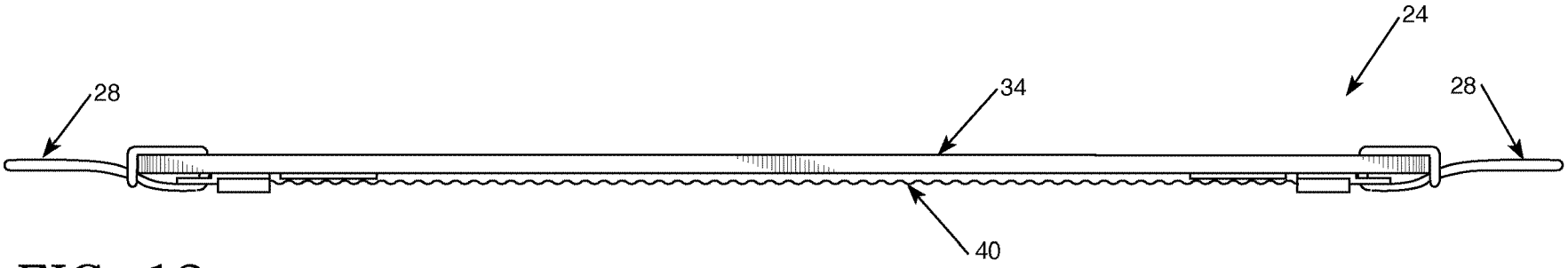
FIG. 12 is a top view of the removable external snare of FIG. 9.
Figure 13:
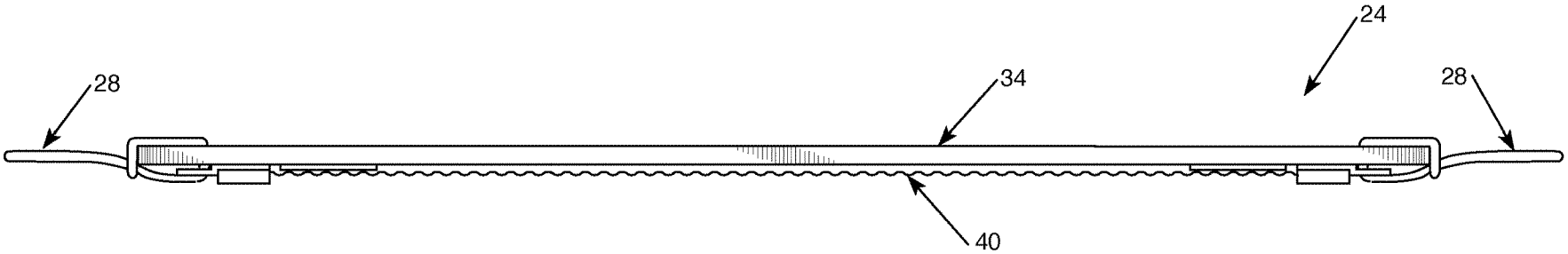
FIG. 13 is a bottom view of the removable external snare of FIG. 9.
Figure 14:
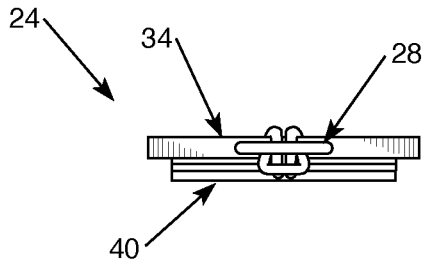
FIG. 14 is a left-side view of the removable external snare of FIG. 9.
Figure 15:
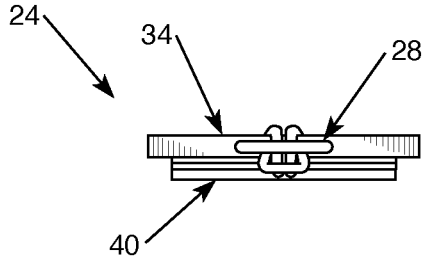
FIG. 15 is a right-side view of the removable external snare of FIG. 9.

FIGS. 1 to 8 show an exemplary embodiment of a percussion instrument 2, and FIGS. 9 to 15 show an exemplary embodiment of a snare assembly 24 as represented in FIGS. 1 to 8.

Referring to FIGS. 1 to 15, the percussion instrument 2 may include a cajon body 4, which is not necessarily limited to any particular size, shape, configuration, or material.

In a preferred aspect, the cajon body 4 may be easily portable and sized to be held while being played. Accordingly, the cajon body 4 may preferably be configured to have a maximum dimension in a range of 9 inches to 27 inches. The maximum diameter is determined as a maximum distance between any two surfaces of the cajon body 4. By way of example, a box-shaped cajon body having a length of 6 inches, a width of 6 inches, and a depth of 1.5 to 3 inches would have a maximum dimension of about 9 inches, a box-shaped cajon body having a length of 18 inches, a width of 18 inches, and a depth of 4.5 to 9 inches would have a maximum dimension of about 27 inches. More preferably, the cajon body 4 may be configured to have a maximum dimension in a range of 12 inches to 24 inches. By way of example, a box-shaped cajon body having a length of 8 inches, a width of 8 inches, and a depth of 2 to 4 inches would have a maximum dimension of about 12 inches, and a box-shaped cajon body having a length of 16 inches, a width of 16 inches, and a depth of 4 to 8 inches would have a maximum dimension of about 24 inches. Even more preferably, the cajon body 4 may be configured to have a maximum dimension in a range of 15 inches to 21 inches. By way of example, a box-shaped cajon body having a length of 10 inches, a width of 10 inches, and a depth of 2.5 to 5 inches would have a maximum dimension of about 15 inches, and a box-shaped cajon body having a length of 14 inches, a width of 14 inches, and a depth of 3.5 to 7 inches would have a maximum dimension of about 21 inches.

In an aspect, the cajon body 4 may include a front striking surface 6. The front striking surface 6 may include any flexible sheet of material durable enough to withstand repeated strikes thereon yet flexible enough to produce and transmit sound ways to an interior of the cajon body. The front striking surface 6 may include any material used or usable as a "tapa" material for any cajon. Typical "tapa" materials include, for example, laminated plywood, several unlaminated layers of thin wood, plastic or fiberglass. In a preferred aspect, the front striking surface 6 may include a laminate including one or more sheets each of birch and mahogany. Preferably, the cajon of the present application may be distinguished from a drum in that the "tapa" material of the front striking surface 6 is fixed to the cajon body 4 whereas a membrane of a drum is stretched across a drum body.

In an aspect, the thickness of front striking surface 6 may vary based on material and design choice. In a preferred aspect, the thickness of the front striking surface 6 is less than ½ inch, preferably less than ¼ inch, most preferably about ⅛ inch.

In an aspect, additional surfaces of the cajon body 4 may include any rigid material that reflects sound waves produced at the front striking surface 6. Typical materials include hardwoods, such as beech, birch, mahogany, and oak, but softwoods, fiberglass, plastic, and a wide variety of materials may be used. In a preferred aspect, additional surfaces of the cajon body 4 are formed from a solid hardwood In an aspect, additional surfaces of the cajon body 4 may be thicker than the front striking surface 6. The thickness may vary based on material and design choice. In an example, the thickness of one or more or all of the additional surfaces is more than ¼ inch, preferably more than ½ inch, most preferably about ¾ inch.

In a preferred aspect, the cajon body 4 may be shaped to form a six-sided box. Accordingly, the cajon body 4 may include a rear surface 8 opposite the front striking surface 6, an upper surface 10 between the front striking surface 6 and the rear surface 8, a lower surface 12 opposite the upper surface 10, a left-side surface 14 between the front striking surface 6 and the rear surface 8 and between the upper surface 10 and the lower surface 12, a right-side surface 16 surface opposite the left-side surface 14.

The cajon body 6 may be assembled in a wide variety of manners. For example, the rear surface 8, the upper surface 10, the lower surface 12, the left-side surface 14, and the right-side surface 16 may be joined together to form a frame by gluing together the surfaces or by nailing or screwing together the surfaces, and the front striking surface 6 may be assembled onto the frame by, for example glue or fasteners (such as screws or nails).

In an aspect, the front striking surface 6 of a box-shaped cajon body 4 may be square-shaped, and the front striking surface 6 may have a length and width in a range of 6 to 18 inches, preferably 8 to 16 inches, more preferably 10 to 14 inches. In another aspect, as illustrated, the depth of the box-shaped cajon body 4 may be considered to be the distance between the front striking surface 6 and the rear surface 8, and the depth may be less than the length and width of the front striking surface 6. In a preferred aspect, the distance between the front striking surface 6 and the rear surface 8 less than 75% of the lower of the length and width of the front striking surface 6, more preferably less than 66% of the lower of the length and width of the front striking surface 6, and more preferably less than 50% of the lower of the length and width of the front striking surface 6.

In a preferred aspect, a plurality of cajon bodies may be made in a variety of different sizes to satisfy different user requirements and/or to a variety of sounds. In a specific example, a 10-inch cajon body may have a front striking surface with a length and width in a range of 9.25 to 10.75 inches. In another specific example, a 12-inch cajon body may have a front striking surface with a length and width in a range of 11.25 to 12.75 inches. In another specific example, a 14-inch cajon body may have a front striking surface with a length and width in a range of 13.25 to 14.75 inches.

In an aspect, the cajon body 4 defines a sound hole 18 therein. The size, shape and position of the sound hole 18 are not necessarily limited. In an aspect, the sound hole 18 is positioned on an upper surface 10, lower surface 12, left-side surface 14 or right-side surface 16 of a box-shaped cajon body 4. In a preferred aspect, the sound hole 18 is positioned on a left-side surface 14 or right-side surface 16 of a box-shaped cajon body 4. In an aspect, the cajon body 4 may be formed from solid wood, and the sound hole 18 may be cut into the cajon body 4.

The percussion instrument 2 may include a sound hole cover 20. Preferably, the sound hole cover 20 is coupled to a surface of the cajon body 4 defining the sound hole 18 and is configured to cover and uncover at least a portion of the sound hole 18, preferably to fully cover and fully uncover the sound hole 18. For example, the sound hole cover 20 may be coupled by way of a fastener 22 to the cajon body 4 and may be rotatable about the fastener 22 to cover and uncover the sound hole 18. Preferably, the sound hole cover 20 is adjustable to any position from fully uncovered to fully uncovered to any amount of coverage therebetween. By way of varying a degree of covering and uncovering the sound hole 18, the sound hole cover 20 provides for a variety of sound effect modifications to the percussion instrument. Moreover, by positioning the sound hole 18 and sound hole cover 20 on an upper surface 10, lower surface 12, left-side surface 14 or right-side surface 16, the sound hole cover 20 may be adjusted with one hand without stopping playing against the front striking surface 6 with the other hand. In yet another aspect, the positioning of the sound hole 18 and sound hole cover 20 on an upper surface 10, lower surface 12, left-side surface 14 or right-side surface 16 permits for use of a shoulder strap 32 to support the cajon body 32 with a user's neck or waist. In this supported configuration, the rear surface 8 of the cajon body 4 rests against a body of the user, and the sound hole 18 and sound hole cover 20 are advantageously not positioned on a rear surface facing the user. Moreover, the sound hole 18 and sound hole cover 20 may be preferably positioned on the left-side surface 14 or right-side surface 16 to permit for easy adjustment of the sound hole cover 20 while the cajon body 4 is hung by shoulder strap 32 by use the user's left or right hand while the other hand is playing the front striking surface 6 when the playing hand extending over the upper surface 10 to contact the front striking surface 6. The shoulder strap 32 may, for example, include a length of material with an adjustment mechanism and an attachment mechanism on each end.

The percussion instrument 2 may include connectors for connecting with shoulder strap 32, in which the connectors are not necessarily limited to any particular size, structure or position. In a preferred aspect, one connector is positioned at an upper portion of the left-side surface and another connector is positioned at an upper portion of the right-side surface. In a preferred aspect, the connectors include guitar strap buttons 30 for connecting to shoulder strip 32.

The percussion instrument may include a snare assembly 24 positionable on an external surface of the front striking surface 6 to produce a snare sound effect upon striking the front striking surface 6. In an aspect, the snare assembly 24 is positionable on a lower portion of the front striking surface 6 to permit the upper portion of the front striking surface 6 to be played by the user. This position of the snare assembly 24 at the lower portion of the front striking surface 6 is particularly advantageous when the cajon body is supported the user by way of the shoulder strap 32. Furthermore, the positioning of the sound hole 18 and sound hole cover 20 on the left-side surface 14 or right-side surface 16 (rather than the lower surface 12) is advantageous to avoid contact of the user's hand with the snare assembly 24 when adjusting the sound hole cover 20.

In an aspect, the snare assembly includes a strip of material 34, which is not necessarily limited to any particular size, shape, or material. The strip of material 34 may be formed of the same or different material from a material of the cajon body 4. For example, the strip of material 34 may include hardwoods, such as beech, birch, mahogany, and oak, softwoods, fiberglass, plastic, and a wide variety of other materials.

In an aspect, the strip of material 34 may have a length equal to or less than a distance between the left-side surface 14 and right-side surface 16 of the cajon body 4. In a preferred aspect, the strip of material 34 may have a length substantially equal to the distance between the left-side surface 14 and right-side surface 16 of the cajon body 4. Accordingly, the length of the strip of material may preferably be in a range of 6 to 18 inches, more preferably 8 to 16 inches, and more preferably 10 to 14 inches.

In an aspect, the strip of material 34 may have a width less than 75% of the distance between the upper surface 10 and the lower surface 12 of the cajon body to ensure that a portion of the front striking surface 6 is exposed. Preferably the strip of material 34 has a width less than 50% of the distance between the upper surface 10 and the lower surface 12 of the cajon body, and more preferably less than 33% of the distance between the upper surface 10 and the lower surface 12 of the cajon body.

In an aspect, the strip of material 34 may have a first surface 36 and a second surface 38 opposing the first surface 36. In an aspect, the first surface 36 and/or the second surface 38 may be substantially flat. A thickness of the strip of material 34 is not limited. In an exemplary embodiment, the thickness is less than 75% of the width of the strip of material 34, preferably less than 50% of the width of the strip of material 34, more preferably less than 33% of the width of the strip of material 34, more preferably less than 25% of the width of the strip of material 34. In another exemplary embodiment, additional features (as further explained below) may be incorporated with the strip of material 34, in which case the thickness of the strip of material 34 may intentionally deviate from the preferred ranges.

In an aspect, the snare assembly 24 may include a plurality of snare wires 40 disposed on the second surface 38 thereof. In the illustrated example, the plurality of snare wires 40 are incorporated strand snare wire device, which may be, for example, a commercially available 8-inch 16 strand snare wire device, and the strand snare wire device is fixed to the second surface 38 of the strip of material 34. In a preferred embodiment, the strand snare wire device is fixed to the second surface 38 using an adhesive.

In an aspect, the snare wires 40 are disposed to contact the front striking surface 6 when the snare assembly is positioned on the front striking surface 6. By contacting the snare wires 40 with the front striking surface 6, a snare sound effect may be produce upon striking of the front striking surface 6. In a preferred aspect, the snare wires 40 are disposed to be elastically biased against the front striking surface 6. By way of example, the snare wires 40 may be coupled at opposing ends of the snare wires 40 to the second surface 38 as opposing ends of the snare assembly 24. More specifically, with respect to the illustrated example, the plurality of snare wires 40 may be coupled to the second surface 38 such that end portions of the each of the snare wires are coupled with the second surface 38 and center portions of the snare wires 40 are arched away (not shown) from the second surface 38 to ensure contact of the snare wires 40 against the front striking surface 6 when the snare assembly 24 is positioned against the front striking surface 6.

In an aspect, the percussion assembly includes elastic connectors for connecting the snare assembly 24 with the cajon body 4. In a preferred aspect, one elastic connector is positioned between a first end of snare assembly 24 and a left-side surface 14 of cajon body 4 and another elastic connector is positioned between a second end of snare assembly 24 and a right-side surface 14 of cajon body 4. In a preferred aspect, the elastic connectors include elastic bands 28. In the illustrated embodiment, the elastic bands 28 are commercially available elastic hair ties.

In an aspect, the snare assembly 24 may include connectors for connecting with the cajon body 24, in which the connectors are not necessarily limited to any particular size, structure or position. In a preferred aspect, one connector is positioned at a first end portion of snare assembly 24 and another connector is positioned at end portion of the snare assembly 24. In a preferred aspect, the connectors include holes 42 extending through the strip of material 24.

In an aspect, the percussion instrument 2 may include connectors for connecting with the snare assembly 24, in which the connectors are not necessarily limited to any particular size, structure or position. In a preferred aspect, one connector is positioned at a lower portion of the left-side surface 14 and another connector is positioned at a lower portion of the right-side surface 16. In a preferred aspect, the connectors 30 include guitar strap buttons 30.

As previously mentioned, strip of material 34 preferably has a length substantially equal to the distance between the left-side surface 14 and right-side surface 16 of the cajon body 4. It has been discovered that, by this substantially equivalence of the length of the strip of material 34 and the distance between the left-side surface 14 and right-side surface 16 of the cajon body 4, an elastic connector positioned between an end of snare assembly 24 and a left-side surface 14 or right-side surface of cajon body 4 can be ensured to apply a compressive force between the snare assembly 24 and the cajon body 4, and thus, the snare assembly 24 is mostly pulled towards the cajon body 4. In contrast, when the strip of material 34 has a length significantly less than the distance between the left-side surface 14 and right-side surface 16 of the cajon body 4, then the snare assembly 24 is mostly pulled outwardly by the elastic connectors. By configuring the snare assembly 24 to be mostly pulled towards the cajon body 4, contact between the snare wires 40 and the front striking surface 6 can be more readily obtained.

By the above-described arrangement of connectors, the snare assembly 24 is advantageously in floating engagement with the cajon body 4 and is removable from the cajon body 4. Moreover, by the above-described arrangement of connectors, the elastic connectors 28 are retained on the snare assembly 24 when the snare assembly is removed. Thus, the elastic connectors 28 are not easily lost when the snare assembly 24 is removed from the cajon body 4. Furthermore, in another aspect, the elastic bands 28 are preferably tied as illustrated to avoid a damping effect of the elastic bands 28 against the front striking surface 6.

In another aspect, the connectors 30 are positioned on the left-side surface 14 and right-side surface 16, and the distance between each connector 30 and the front striking surface 6 is approximately equal to the distance between each connector and the lower surface 12. By this positioning the connectors 30, the snare assembly 24 can be pulled downward to disengage with the front striking surface 6 and engage with the lower surface 12. By moving the snare assembly 24 to the lower surface, the snare sound effect can be avoided or minimized without removable of the snare assembly 24 from the cajon body 4. Moreover, by positioning the sound hole 18 on the left-side surface 14 or right-side surface 16 (rather than the lower surface 12), the ability to move the snare assembly 24 to engage with the lower surface 12 is ensured.

The percussion instrument 2 as described and illustrated provides for a versatility of uses as further described below.

According to a feature of the snare assembly 24 as described and illustrated, the snare assembly is removable from the front striking surface 6. The removability of the snare assembly 24 is advantageous to improve a versatility of the percussion instrument 2. In this regard, the percussion instrument 2 may be used with the snare assembly 24 positioned on the front striking surface 6 to produce a snare sound effect or may be used with the snare assembly 24 removed to producing the drumming sound with the snare effect sound.

Moreover, as previously described, the percussion instrument 2 may be used with the sole hole 18 covered or uncovered. Thus, in combination with the removable snare assembly 24, the removability of the snare assembly 24 may provide for a synergetic versatility of uses. Indeed, the percussion instrument 2 may be used with the sound hole 18 uncovered and snare assembly 24 engaged to produce a loud drumming sound with snare sound effect, or the percussion instrument 2 may be used with the sound hole 18 covered and snare assembly 24 engaged to produce a dull drumming sound with snare sound effect, or the percussion instrument 2 may be used with the sound hole 18 uncovered and snare assembly 24 disengaged to produce a loud drumming sound with no snare sound effect, or the percussion instrument 2 may be used with the sound hole 18 cover and snare assembly 24 disengaged to produce a dull drumming sound with no snare sound effect.

As previously mentioned, the snare assembly 24 may incorporated additional sound features with the strip of material 34.

In an aspect, the snare assembly 24 may be configured to readily removable from the cajon body 4. In this case, additional features that utilize the snare assembly 24 in the removed state may be incorporated. More specifically, the snare assembly 24 may incorporate a feature that produces an additional sound effect when shaken.

In an example, the snare assembly may include a plurality of shaker beads incorporated into the snare assembly, in which the shaker beads are disposed inside the strip of material thereby produce a rattle sound when shaken. In this case, the strip of material may include, for example, a hollow central portion filled with shaker beads and covered, or the strip of material may include two opposing strips of material joined together and having a central portion filled with shaker beads. In another example, the snare assembly may include bells the produce a sound when shaken.

In another aspect, the snare assembly 24 may produce additional sound effects when the first surface 36 of the strip of material 24 is contacted by a user of the percussion instrument 2. In an example, the snare assembly 24 may include one or more tambourines on the first surface 36. In another example, the snare assembly 24 may include a clicking device that produces a clicking sound when contacted by a user.

Although various embodiments of the disclosed cajon and external snare have been shown and described, modifications may occur to those skilled in the art upon reading the specification. The present application includes such modifications and is limited only by the scope of the claims.

What is claimed is:

1. A percussion instrument, comprising:

a cajon body including a front striking face, a rear face, an upper face, a lower face, a left-side face, and a right-side face;

a floating snare assembly positioned at a portion of the front striking face, the floating snare assembly including at least one snare wire contacting the front striking face; and at least one connector connecting the cajon body and the floating snare assembly, wherein the at least connector includes:

a first elastic band removably connecting between a lower portion of the left-side face of the cajon body and a first end portion of the floating snare assembly; and a second elastic band removably connecting between a lower portion of the right-side face of the cajon body and a second end portion of the floating snare assembly.

2. The percussion instrument of claim 1, wherein a sound hole is defined in the left-side face or right-side face of the cajon body.

3. The percussion instrument of claim 2, further comprising a sound hole cover coupled to the left-side face or right-side face of the cajon body.

4. The percussion instrument of claim 2, further comprising a first strap connector on an upper portion of the left-side face and a second strap connector on an upper portion of the right-side face.

5. The percussion instrument of claim 1, wherein the cajon body has a maximum dimension in a range of 9 inches to 27 inches.

6. The percussion instrument of claim 1, further comprising a sound hole in the cajon body.

7. The percussion instrument of claim 6, further comprising an adjustable sound hole cover coupled to the cajon body and configured to cover and uncover at least a portion of the sound hole.

8. The percussion instrument of claim 6, wherein the adjustable sound hole cover is coupled to the cajon body by way of a fastener, and wherein the adjustable sound hole cover is rotatable about the fastener to cover and uncover the portion of the sound hole.

9. The percussion instrument of claim 1, wherein the floating snare assembly further includes a strip of material having a first surface and a second surface opposite the first surface, the strip of material having a first connector at a first end portion thereof and having a second connector at a second end portion thereof, wherein the at least one snare wire is coupled to the second surface of the floating snare assembly.

10. The percussion instrument of claim 9, wherein the first and second connectors are first and second holes extending through the strip of material.

11. The percussion instrument of claim 9, wherein a plurality of snare wires are coupled to the second surface.

12. The percussion instrument of claim 11, wherein ends of each snare wire are coupled to the second surface and central portions of each snare wire extend outwardly from the second surface.

13. The percussion instrument of claim 9, wherein a length of the strip of material is in a range of 6 to 18 inches.

14. A percussion instrument, comprising:

a cajon body including a front striking face, a rear face, an upper face, a lower ace, a left-side face, and a right-side face;

a first connector fixed to a lower portion of the left-side face of the cajon body;

a second connector fixed to a lower portion of the right-side face of the cajon body;

a floating snare assembly positioned at a portion of the front striking face, the floating snare assembly including at least one snare wire contacting the front striking face;

a first elastic band having a first end and a second end, wherein the first end of the first elastic band is connected to a first end portion of the floating snare assembly, and wherein the second end of the first elastic band is removably connected to the first connector; and a second elastic band having a first end and a second end, wherein the first end of the second elastic band is connected to a second end portion of the floating snare assembly, and wherein the second end of the second elastic band is removably connected to the second connector.

15. The percussion instrument of claim 14, wherein at least one of the first connector and the second connector is a guitar strap button.

16. The percussion instrument of claim 14, wherein the first end of the first elastic band is removably connected to the first end portion of the floating snare assembly, and wherein the first end of the second elastic band is removably connected to the second end portion of the floating snare assembly.

17. The percussion instrument of claim 16, wherein the first elastic band is ring-shaped, and wherein the second elastic band is ring-shaped.

18. The percussion instrument of claim 17, wherein the first end of the ring-shaped first elastic band is removably connected to the first end portion of the floating snare assembly by passing the first elastic band through a hole at the first end portion of the floating snare assembly and then passing the second end of the ring-shaped first elastic band through the center of the first end of the ring-shaped first elastic band, and wherein the first end of the ring-shaped second elastic band is removably connected to the second end portion of the floating snare assembly by passing the second elastic band through a hole at the second end portion of the floating snare assembly and then passing the second end of the ring-shaped second elastic band through the center of the first end of the ring-shaped second elastic band.

* * * * *